US005878960A

United States Patent [19]

McInerney, II et al.

[11] Patent Number: 5,878,960

[45] Date of Patent: Mar. 9, 1999

[54] PULSE-WAVE-MODULATED SPRAY VALVE

[75] Inventors: Robert J. McInerney, II, Holland, Mich.; David L. Celek, Westerville, Ohio; James J. Mahon, III, Lancaster, Ohio; Michael K. Forry, Upper Arlington, Ohio; Kurt R. Swartzlander, Gahanna, Ohio

[73] Assignee: Rimrock Corporation, Columbus, Ohio

[21] Appl. No.: 807,556

[22] Filed: Feb. 28, 1997

[51] Int. Cl.[6] ..... B05B 7/12; B05B 1/30; F02M 51/00

[52] U.S. Cl. ..... 239/412; 239/585.3; 239/900

[58] Field of Search ..... 239/585.1, 585.3, 239/408, 412, 900; 251/129.05, 129.16

[56] References Cited

U.S. PATENT DOCUMENTS

| | | | |
|---|---|---|---|
| 3,224,677 | 12/1965 | Schmidt et al. . | |
| 3,884,417 | 5/1975 | Sheffield et al. | 239/102 |
| 4,141,231 | 2/1979 | Kudlich . | |
| 4,142,684 | 3/1979 | Schweitzer | 239/585 |
| 4,214,704 | 7/1980 | Nagai | 239/187 |
| 4,430,983 | 2/1984 | Hagen | 123/585 |
| 4,570,598 | 2/1986 | Samson et al. | 239/585.3 X |
| 4,635,493 | 1/1987 | Buckley | 74/99 |
| 4,985,715 | 1/1991 | Cyphert et al. . | |
| 5,035,358 | 7/1991 | Katsuno et al. | 239/900 X |
| 5,134,961 | 8/1992 | Giles et al. . | |
| 5,174,505 | 12/1992 | Shen | 239/408 X |
| 5,197,674 | 3/1993 | Ketterer et al. | 239/408 |
| 5,277,400 | 1/1994 | Bierther | 251/129 |
| 5,360,166 | 11/1994 | Nogi et al. | 239/408 X |
| 5,397,061 | 3/1995 | Buchholz et al. | 239/408 X |
| 5,409,169 | 4/1995 | Saikalis et al. | 239/900 X |
| 5,526,796 | 6/1996 | Thring et al. | 239/408 X |
| 5,540,387 | 7/1996 | Reiter et al. | 239/408 |
| 5,597,121 | 1/1997 | Munezane et al. | 239/408 |
| 5,626,292 | 5/1997 | Armaroli et al. | 239/408 |

FOREIGN PATENT DOCUMENTS

| | | |
|---|---|---|
| 19527443 | of 0000 | Germany . |
| 3834674 | of 0000 | Germany . |
| 4013064 | of 0000 | Germany . |

*Primary Examiner*—Lesley D. Morris
*Attorney, Agent, or Firm*—Rankin, Hill, Porter & Clark LLP

[57] ABSTRACT

A pulse-wave-modulated spray control valve for controlling the release of a liquid to a flowing air stream for the purpose of atomizing the liquid to form a spray. The assembly includes a solenoid which is adapted to control reciprocating movement of an armature assembly that includes a valve head movable between an extended position in sealing engagement with a valve seat and a retracted position that permits liquid to enter a flow passage for a gaseous propellant. The solenoid is operated in response to energizing pulses which are modulated to control the flow rate of the liquid through the valve.

9 Claims, 7 Drawing Sheets

PULSE-WAVE-MODULATED SPRAY VALVE

This invention relates to equipment for spraying a liquid product such as a lubricant, and especially to spraying a lubricant, using a gas propellant, on the working or forming surfaces of various types of metal working equipment such as die casting machines. Such machines require that a lubricant be sprayed on the die surfaces between forming cycles. More particularly, the invention relates to a spray valve control system for regulating the flow rate and flow interval for the liquid lubricant or other liquid product being delivered to the gas propellant to be atomized for generating the spray.

In many industrial forming processes such as the molding, die casting, drawing, and forging of metals and other materials, it is common practice to apply a lubricant to the working surfaces between each forming cycle. At the same time, while the mold or die sections are separated, other operations are often performed, such as blowing air against the forming surfaces to remove any residual flash that may remain around the die cavities, and also blowing air or spraying air and water to cool surfaces which are difficult to cool with the integral circulating cooling system normally provided.

The lubricant, which is generally in liquid form, improves the flow of the metal or other material being formed, reduces wear of the working parts, and facilitates removal of the newly formed product from the mold or die. Often different types of liquid lubricant are sprayed during an operating cycle.

To apply the lubricant automatically and thus avoid the necessity of having a worker move between the opposed platens of an open die or mold between cycles, mechanical reciprocating devices are commonly used. These devices move a spray head past the surfaces of the mold or die to be lubricated, while the platens are separated, and spray intermittently so as to apply the lubricant to the desired surfaces. Such devices commonly have air blast nozzles as well to help cool various working parts and to remove flash.

These devices are generally referred to as reciprocators and typical reciprocators are shown in U.S. Pat. Nos. 4,214,704 and 4,635,493. Some reciprocators utilize fluid drive means such as hydraulic or pneumatic cylinder-and-piston assemblies. Most devices utilize purely electromechanical drives.

In any event, the reciprocating spray head must be supported in a retracted rest position well above the dies in order to provide clearance for the die assembly to move to its closed operating position.

In all of these devices, a reciprocator control system must be provided to achieve the necessary precision in order to assure that the blowing and lubricating cycle is accurately repeated each time. The available control technology is adequate to achieve the desired results, however, existing equipment does present certain difficulties.

One difficulty is due in part to the practice of utilizing a relatively high-pressure air flow as a propellant to generate the spray of lubricant. Due to complexities in the liquid supply passages that supply liquid to the moving air stream, variations in flow rate can occur during the operating cycle and also between the individual spray heads. This can result in excess liquid being sprayed in some areas of a working surface and insufficient amounts in other areas. While these variations can be reduced to some extent by controlling the duration of the interval in which liquid lubricant is supplied to the air stream, this solution is inexact and often difficult to regulate.

The device of the present invention reduces the difficulties described above and affords other features and advantages heretofore not obtainable.

SUMMARY OF THE INVENTION

The spray system of the present invention utilizes a gas propellant for atomizing and spraying a liquid such as a liquid lubricant and provides an integral valve for controlling the flow rate of the liquid to be sprayed. The spray valve includes a housing defining a nozzle opening, a flow passage for the propellant to be emitted through the nozzle opening, a flow passage for the liquid and a valve seat with a port communicating between the liquid flow passage and the propellant flow passage.

Located within the housing is an armature assembly including a valve head movable between an extended position in sealing engagement with the valve seat, and a retracted position permitting liquid to enter the propellant flow passage from the liquid flow passage. A solenoid in the housing is adapted to receive the armature in operative relation thereto and is adapted when energized to move the armature and valve head to the retracted position.

Resilient means (e.g. a helical spring) is provided to urge the valve head to the closed position in opposition to the electromotive force generated by the solenoid. A pulse generating means is provided for applying a controlled train of current pulses to the solenoid to control the flow of liquid therefrom into the propellant flow path.

DESCRIPTION OF THE PREFERRED EMBODIMENT

Figure 1:
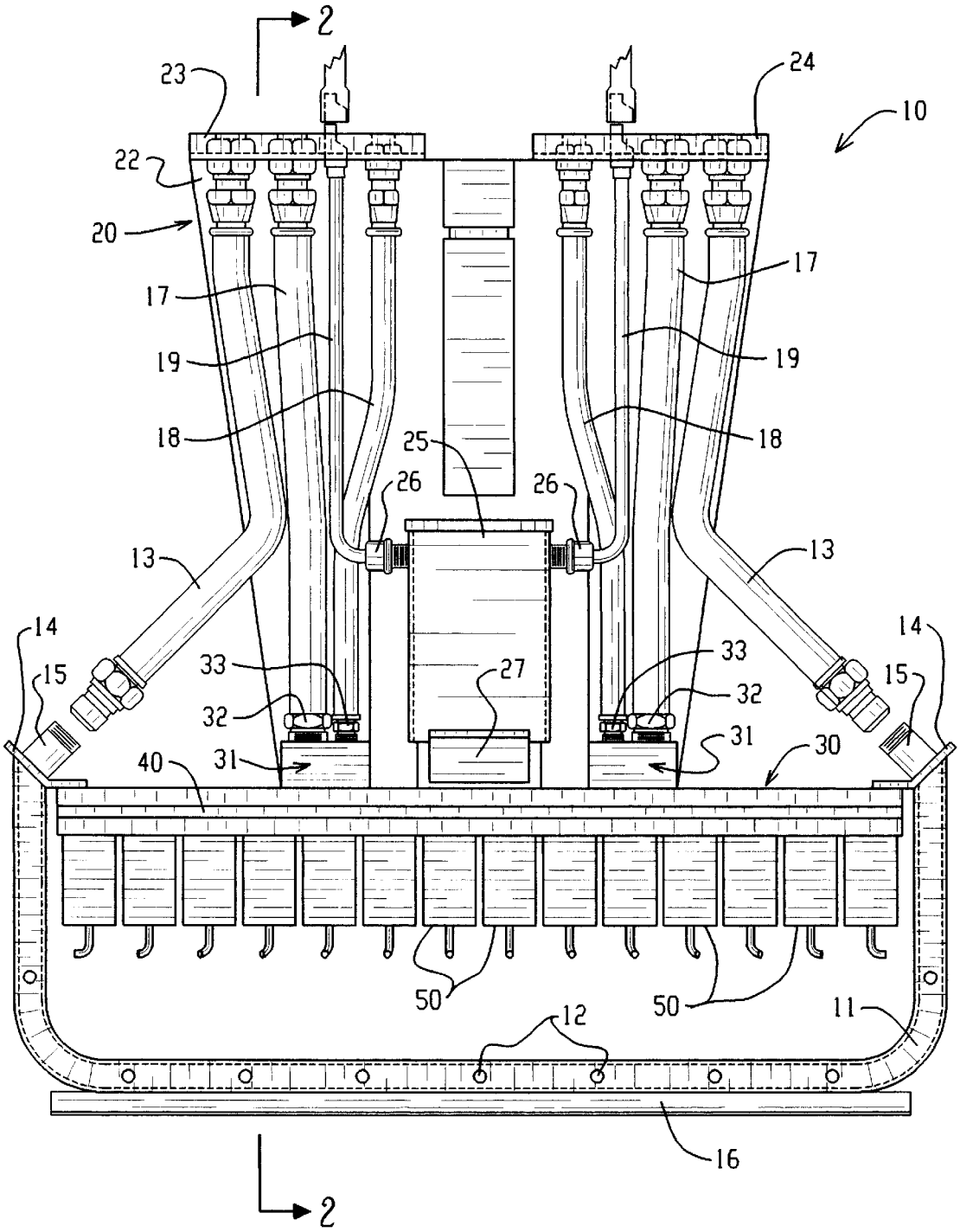
FIG. 1 is an elevational view of a reciprocator arm assembly adapted to carry a number of spray control valves embodying the invention.

While the pulse-wave-modulated spray control valve of the present invention has application in many industrial processes, it will be described herein with respect to a reciprocator for moving a fluid emission head 10 automatically through successive operating cycles into and from a space within which predetermined spray operations are to be performed. More particularly, the reciprocator is adapted for use in association with a die casting machine.

The fluid emission head or a spray head 10 is moved successively through variable speed, variable function operating cycles that include extension and retraction to and from a position between die sections when in their open position between molding cycles, and wherein the spray head performs predetermined spraying and blowing operations in a programmed sequential manner.

GENERAL ARRANGEMENT

The spray head assembly 10 (FIGS. 1, 2, and 3) includes as its primary components a frame assembly 20, a manifold assembly 30, a plurality of pulse-wave-modulated spray control valves 50, and a control system 100.

In the typical arrangement shown, the spray head assembly 10 includes a blow air tube 11 having a generally U-shaped configuration and being supplied with a number of blow air nozzles 12. The air tube 11 is provided with air under relatively high pressure through a pair of supply hoses 13 that are connected to brackets 14 mounted on the manifold assembly 30. The brackets 14 support couplings 15 to which the supply tubes 13 are connected.

The spray head assembly also includes a pair of spray air supply hoses 17, a pair of lubricant supply hoses 18, and a pair of electrical conduits 19.

The frame assembly 20 includes a pair of parallel side plates 21 and 22 with side edges that are tapered inwardly from top to bottom and serve to support the other frame members. A pair of top brackets 23 and 24 are secured to the side plate 22 and are spaced from one another at their inner ends to leave a central opening.

The plates 21 and 22 support couplings for the blow air hoses 13, the spray air supply hoses 17, the lubricant supply hoses 18, and the electrical conduits 19. Thus, the hoses 13, 17, 18, and 19 may be connected to flexible hoses that accommodate the reciprocating movement of the spray head 10.

A junction box 25 is located between the side plates 21 and 22 near the lower end thereof and provides connectors 26 for the two electrical conduits 19. A pair of support brackets 27 and 28 are located on opposite sides and secured to the respective side plates 21 and 22 to provide connection points for the manifold assembly 30.

MANIFOLD ASSEMBLY

The manifold assembly 30 includes a manifold adaptor 31 and from one to four manifold modules 40. The manifold adapter 31 is mounted between the side plates 21 and 22 below the electrical junction box 25 and at the bottom end of the side plates. Located on the top surface of the adapter 31, are a pair of connectors 32 for the spray air supply hoses 17, and a pair of connectors 33, for the lubricant supply hoses 18.

Figure 2:
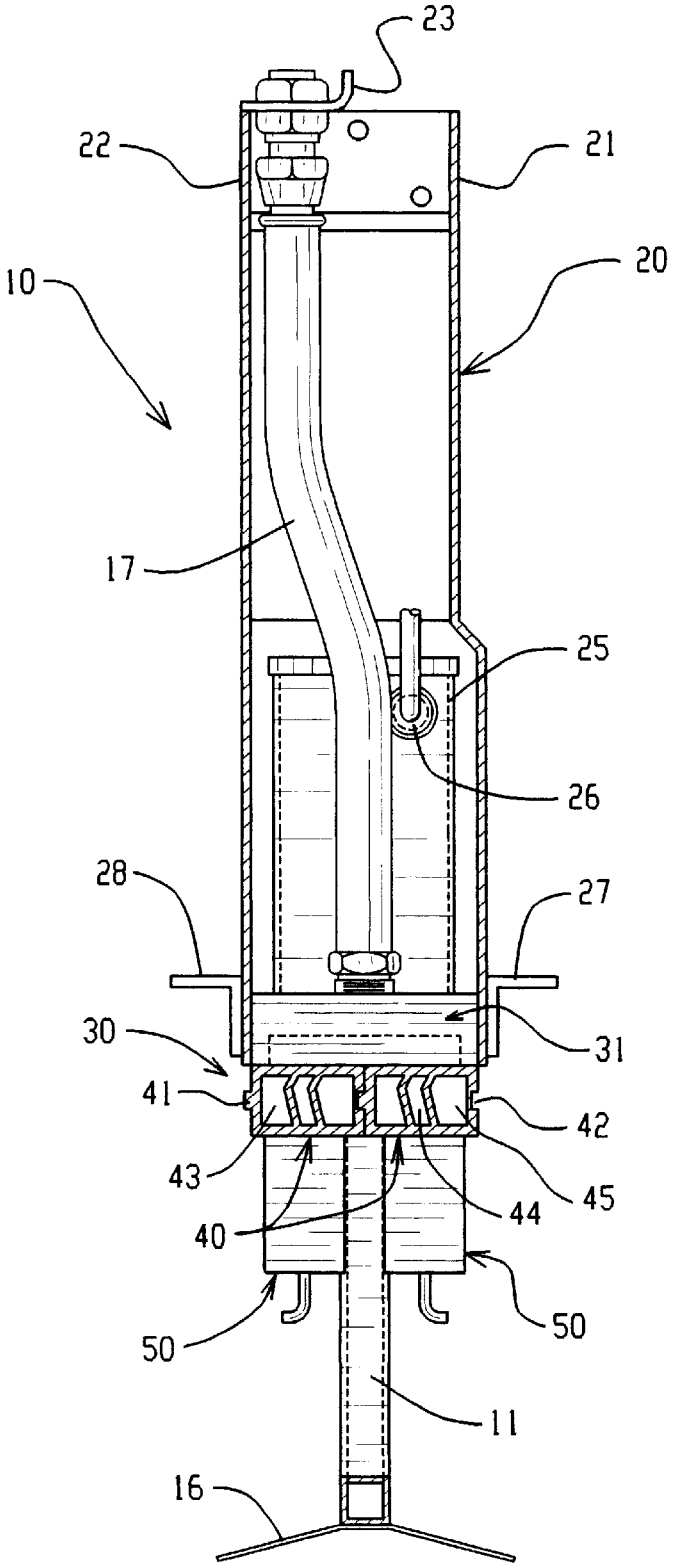
FIG. 2 is a sectional view taken on the line 2—2 of FIG. 1.
Figure 3:
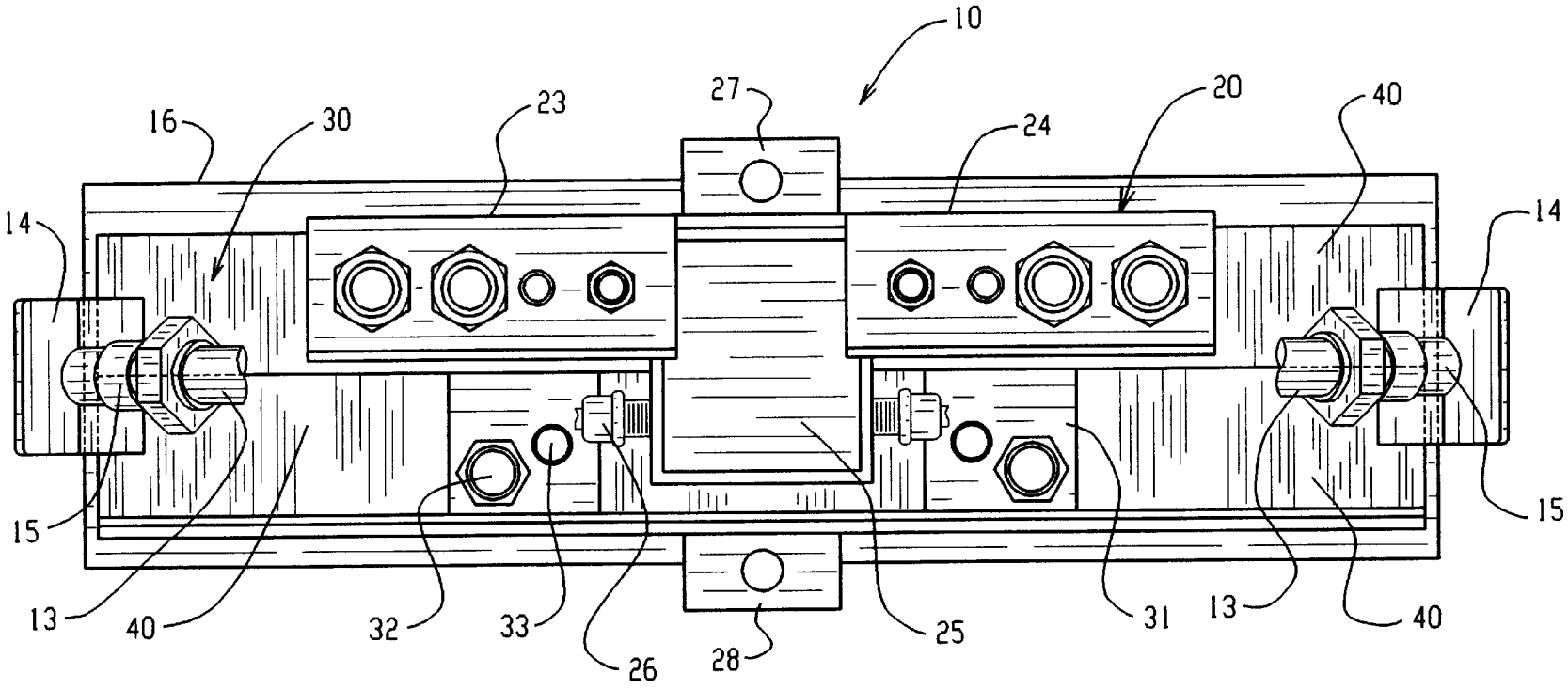
FIG. 3 is an elevational view taken from above with parts broken away for the purpose of illustration.
Figure 4:
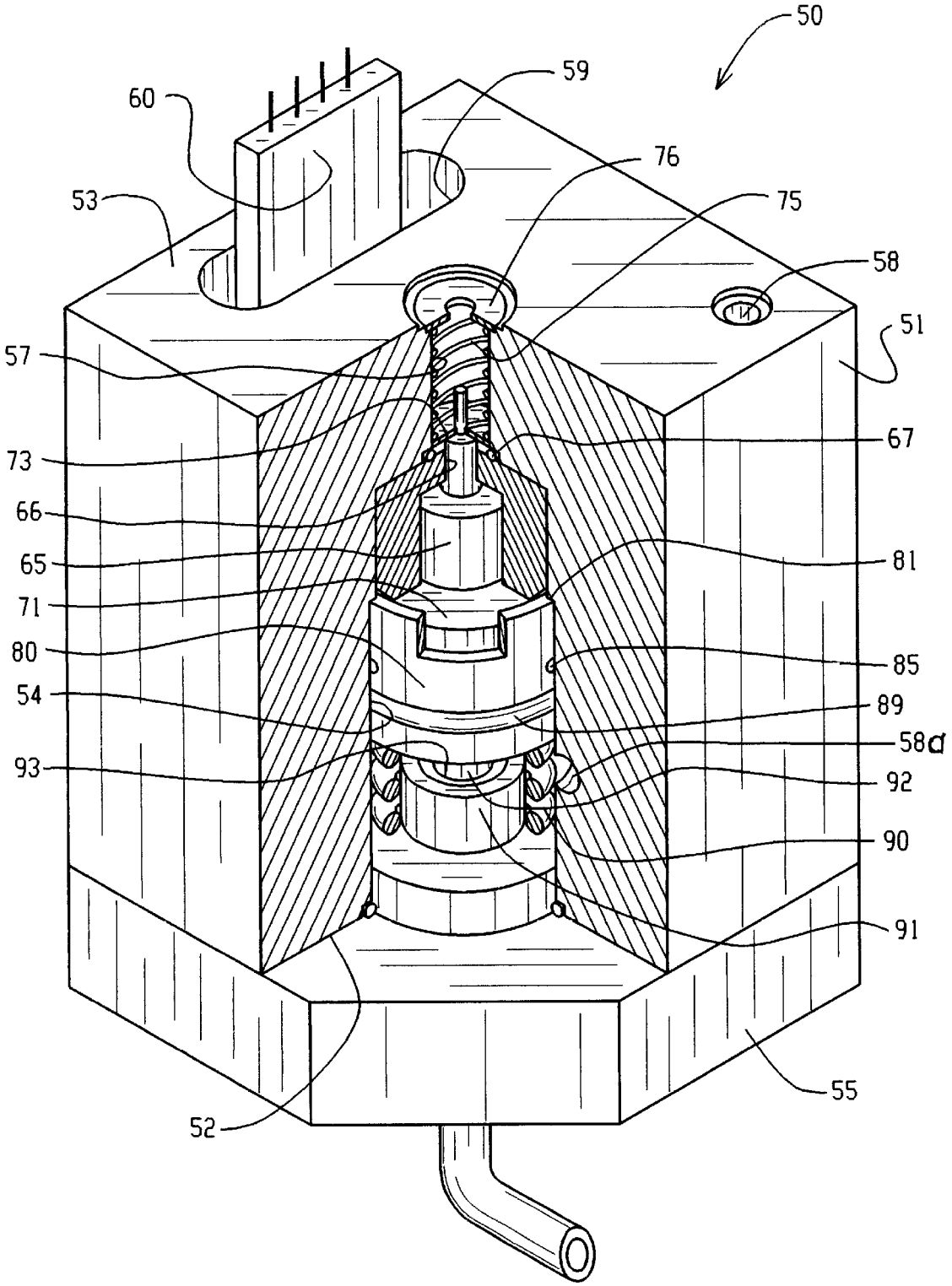
FIG. 4 is an isometric view of a spray control valve embodying the invention with parts broken away for the purpose of illustration.
Figure 5:
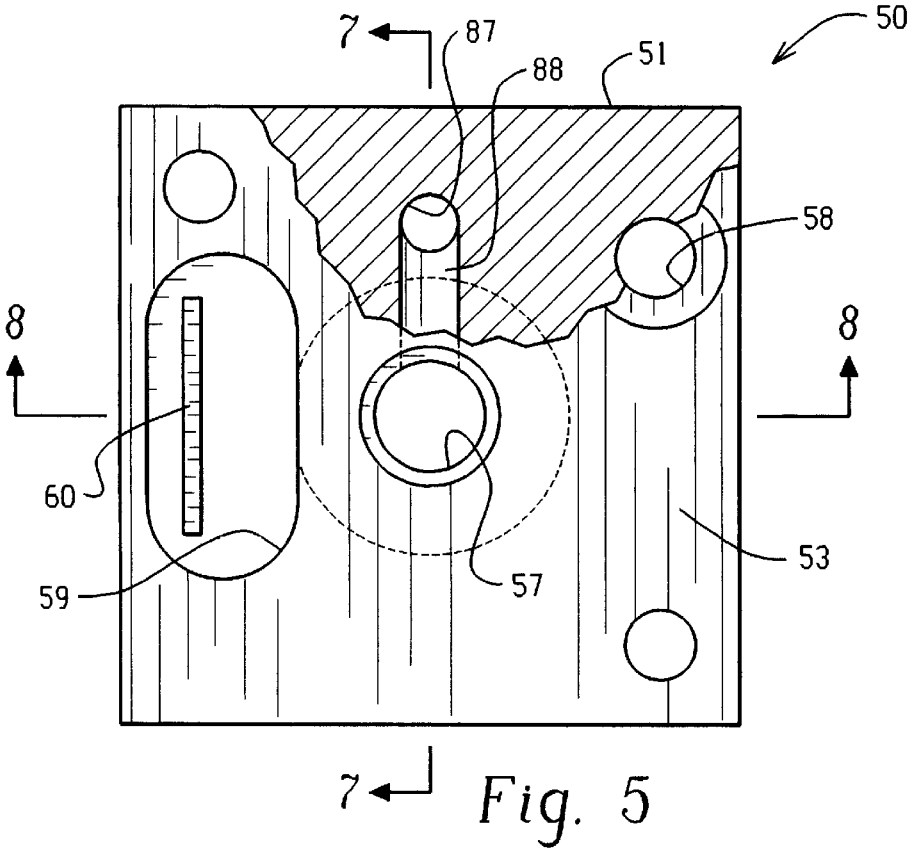
FIG. 5 is a plan view showing the top surface of the spray control valve of FIG. 4.
Figure 6:
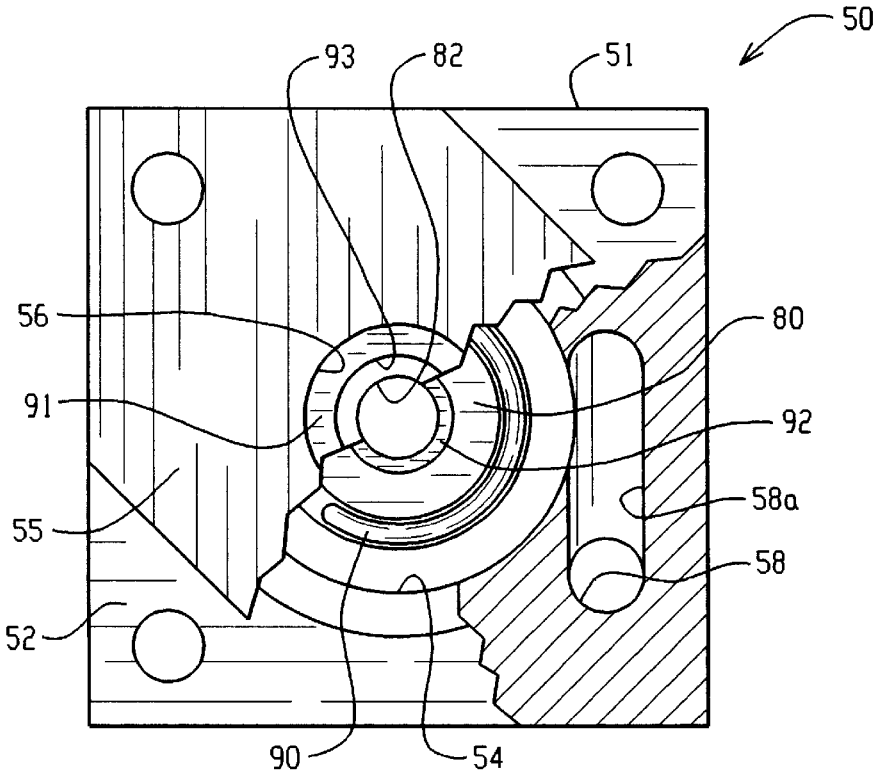
FIG. 6 is an elevational view from below of the spray control valve of FIGS. 4 and 5.

Located centrally in the manifold adapter 31 is a recess for printed circuit boards forming part of the control system 100. Connected to the bottom surface of the manifold adapter 31, are from one to four manifold modules 40, two such modules being used in the embodiment illustrated and described herein. The modules are best shown in FIGS. 2 and 3. Pairs of modules 40 may be connected together side-by-side by means of a rib 41 formed on one side of each module, and a matching groove 42 formed on the opposite side (see FIG. 2). Thus, one of the two adjacent modules 40 may be used to support spray valves on one side of the spray head and the other, to support spray valves on the opposite side. Each module is provided with an internal air passage 43 for spray air, an internal liquid passage 44 for the liquid lubricant, and a passage 45 for electrical conductors.

Access ports are provided at spaced locations along the length of each module 40 to provide communication from the passages 43, 44, and 45 to the spray valve assemblies 50, mounted on the bottom of the manifold modules 40.

SPRAY VALVE ASSEMBLIES

The spray valve assemblies 50 are secured by machine screws to the bottom of the manifold modules 40 in side-by-side relation as best illustrated in FIGS. 1 and 2. In the embodiment illustrated, fourteen spray valve assemblies are connected to each manifold module. The spray valve assemblies are all oriented to spray from the bottom ends thereof and spray tips may be attached to form a desired spray pattern directed to the die cavities on opposite sides of the spray head.

Each of the valve assemblies (best shown in FIGS. 4–8) includes a valve body 51 formed, for example, of a rectangular aluminum block and having a forward end 52 and a rearward end 53. A circular bore 54 is formed in the forward end and extends inward about ¾ of the length of the valve body 51. An end cap 55 is secured to the forward end 52 and has a circular opening 56 that is axially aligned with the bore 54 but which has a much smaller diameter. A smaller circular bore 57 is formed from the rearward end 53 of the valve body 51 and extends through to the bore 54 in axial alignment therewith. The bore opening in the rearward end 53 of the valve body registers with an access port in the respective manifold block 40 to supply liquid lubricant to the spray valve 50 through the bore 57.

A circular air inlet passage 58 is also drilled into the valve body from its rearward end and extends inward about ¾ of the length of the body. A lateral passage 58*a* communicates between the air passage 58 and the bore 54 to permit the air to be supplied to the bore 54 at the location best shown in FIG. 6. The opening in the air passage 58 in the rearward end face 53 of the valve body registers with an access port in the respective manifold block 40 to supply air under pressure to the spray valve 50 through the passage 58.

A recess 59 is formed in the valve body 51 on the other side of the bore 57 from the air passage 58 and is adapted to receive a circuit board 60 that provides an amplifier for the signal used to control the operation of the valve as will be described in more detail below. The recess 59 communicates at its lower end with the bore 54.

A valve control solenoid 65 is located in the inner portion of the bore 54 and has a central opening 66 at one end that is axially aligned with the axis of the bore 57. An "O" ring seal 67 is provided where the face of the solenoid intersects the bore 57.

Also the solenoid 65 has a central chamber 68 and is adapted to cooperate with an armature assembly 70. The armature assembly 70 has an armature plate 71 and a rearward extension 72 that extends through the central opening 66 into the bore 57. An armature washer 73 is secured to the extension 72 and forms a forward seat for a helical armature spring 75 received in the bore 57. The upper end of the spring 75 engages a spring retainer 76 secured at the outer end of the bore 57. Accordingly, the helical armature spring 75 urges the armature assembly 70 in a forward direction. The armature plate 71 has a carbide ball 79 fused to its forward end face to provide a movable valve component which responds to the energization of the solenoid 65.

Located within the bore 54 is a hub insert 80 positioned just forwardly of the solenoid 65, and which seats against an annular shoulder formed in the bore 54. The hub insert 80 has a central bore 82 formed therein and in axial alignment with the bore 54. A counterbore of somewhat larger diameter is formed at the rearward end of the armature in alignment with the central bore 82. The counterbore 83 provides an operating chamber for the carbide ball 79.

Four radial ports 85 are formed in the hub insert 80 and extends in a radial direction to a lateral opening 86 formed in the valve block 51. The opening 86 communicates with a liquid passage 87 that extends parallel to the central axis. The passage 87 communicates with a lateral passage 88 that extends from the bore 57. Thus, lubricant can flow freely from the spring chamber 57 through the valve block 51 to the operating chamber 83.

A tubular carbide valve element 84, formed of carbide steel is fitted in the central bore 82 in the hub insert 80 and its rearward end provides a seat for the carbide ball 79. An "O" ring 89 located in an annular groove formed in the hub insert provides a seal between the cylindrical walls of the bore 54 and the hub insert 80.

Located at the outer end of the bore 54 with its outer face adjacent the inner face of the endcap 55, is a spring cap 91. The spring cap 91 has an inwardly extending boss 92 and a tapered passage 93 extending axially therethrough. A stainless steel helical spring 90 is positioned in the bore 54 around the boss 92 in a manner that urges the hub insert 80 and the spring cap 91 tightly into their respective fixed positions.

The tapered passage 93 in the spring cap 91 provides a throat through which air flowing through the air passage 58 flows from the interior of the valve outwardly through the bore 56 in the endcap 55. As the air flows through the throat, liquid passing through the central bore 82 in the hub insert 80 is intermixed in the air stream in the form of small particles, and propelled outwardly with the expanding fluid flow.

Figure 8:
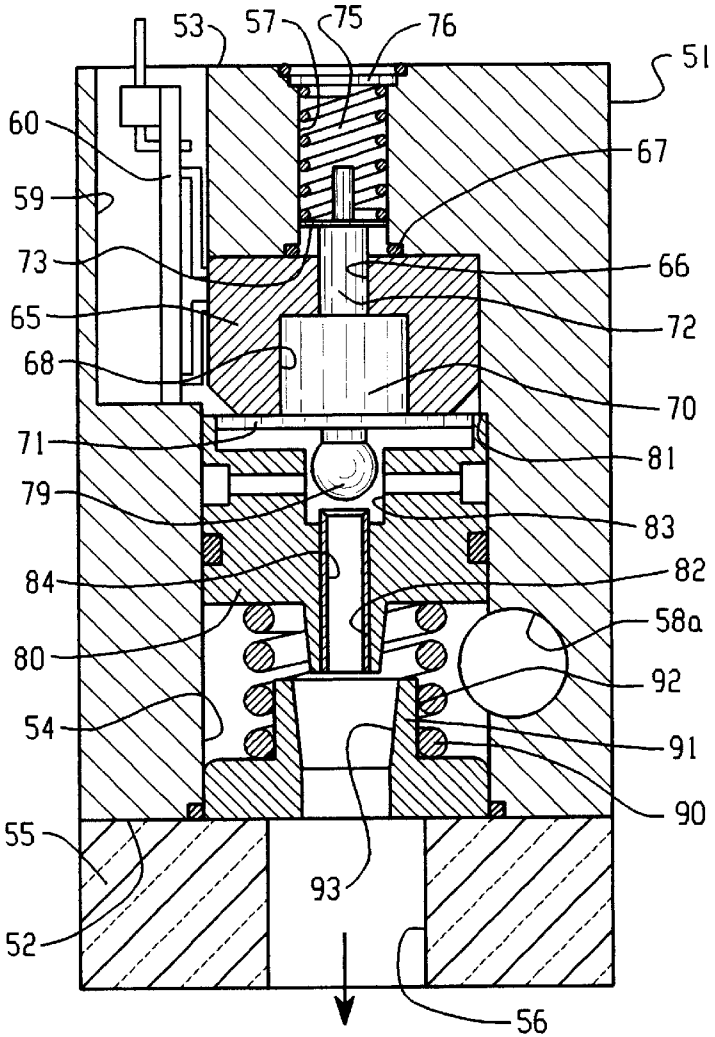
FIG. 8 is a sectional view on an enlarged scale taken on the line 8—8 of FIG. 5 and showing the valve in its open position.

Accordingly, two media flow into each spray valve 50 through separate passages. These include low pressure spray air (50–80psi) and low pressure liquid (usually a die release agent or lubricant at about 40–70psi). Both enter the valve body 51 through the respective openings that communicate with the respective manifold block. The air under pressure is unrestricted and may flow through the valve whether the valve is energized (solenoid on) or in its rest state (solenoid off). The lubricant is metered by means of the solenoid 65. As indicated above, the armature 70 is held in its valve closed (FIG. 7) position by the armature spring 75. When the solenoid is energized, it pulls the armature towards it compressing the spring 75 and opening the flow path for the liquid lubricant (FIG. 8).

The solenoid 65 is energized by a pulse wave generated by the control system 100, the pulse frequencies being quite high (up to 80 wh). When the ratio of energized to deenergized time is varied, the amount of flow is also changed. By altering the energy ratio of the solenoid and mixing the metered lubricant with a constant flow of air, the atomized liquid spray may be controlled in a precise manner. This will permit the user to change the amount of spray that is desired without changing system pressures.

CONTROL SYSTEM

Figure 9:
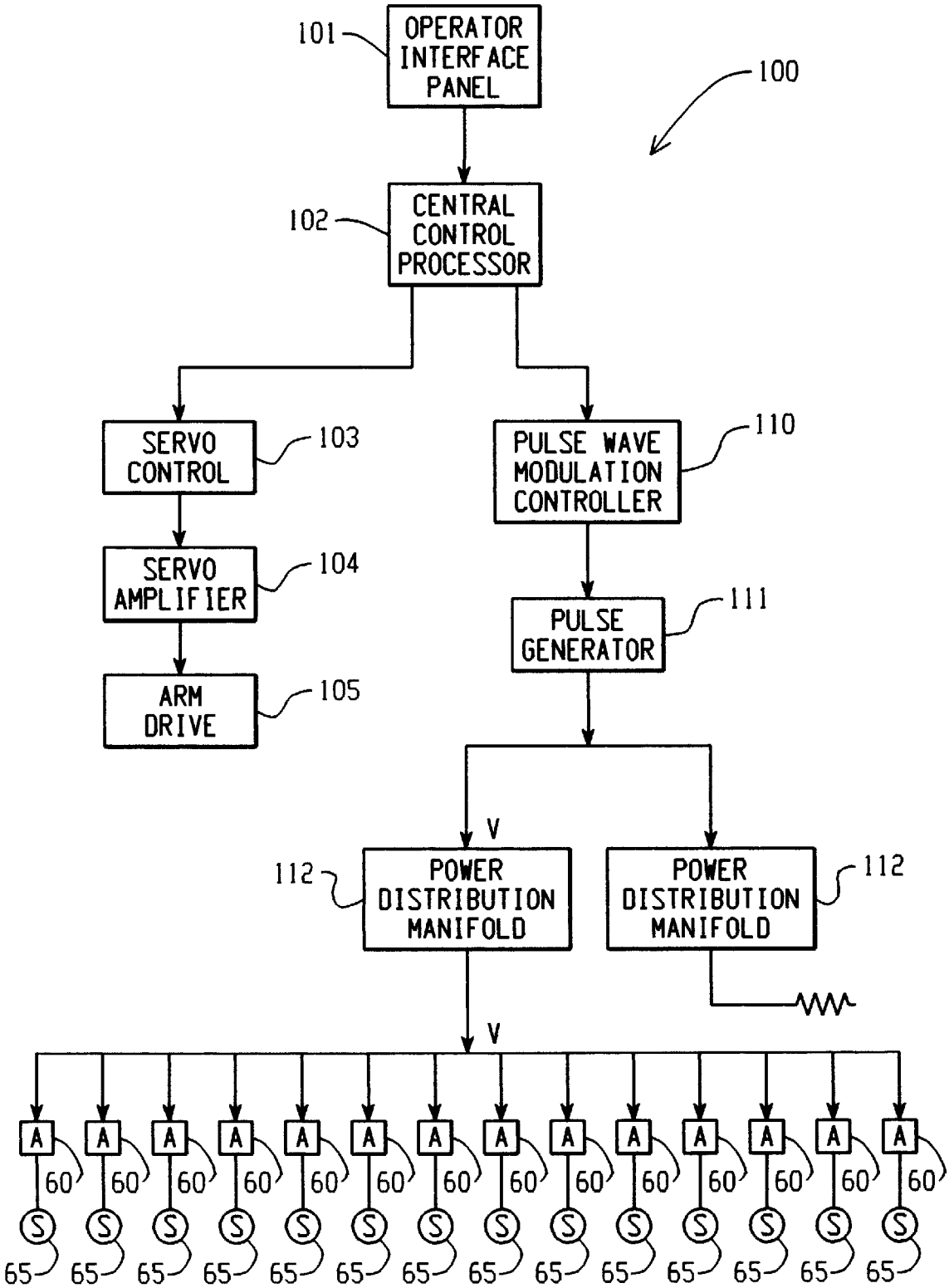
FIG. 9 is a schematic diagram illustrating the control system for a number of spray control valves embodying the invention and carried by the reciprocator arm assembly of FIGS. 1 and 2.

The control system 100 is shown schematically in FIG. 9. While the system serves to control several functions of a typical reciprocator to include the reciprocating movement of the spray head assembly 10 and the activation of valves for controlling blow air and spray air, the description here will be limited to the control of the pulse-wave-modulated spray control valves 50.

It will be understood that each spray control valve 50 of the spray head assembly 10 is controlled separately by the control system 100 so that each valve operates independently of the others. Accordingly, the various spray valves can all have a different flow rate depending on the particular application.

The control system 100 includes an operator interface panel 101 which may be used to program the operation of the reciprocating spray head to achieve the desired results for the particular operation. The interface panel 101 is connected to a central control processor which is used to control both the movement of the reciprocating spray head assembly 10 and the actuation of the pulse-wave-modulated spray control valves 50. That portion of the system that controls the reciprocating spray head assembly includes a servo control 103, a servo amplifier 104 and an arm drive 105. That portion of the system that controls the operation of the pulse-modulated spray control valves 50 includes a pulse-wave-modulation controller 110 connected to the central control processor 102 and a pulse generator 111. The pulse generator 111 is connected to the two power distribution manifolds 112, there being one manifold 112 for each manifold modules 40.

While two power distribution manifolds 112 are shown, only one is illustrated in connection with the respective pulse-wave-modulated spray control valves. Accordingly, only one of the two sets of spray control valves are illustrated, the other row being connected in essentially the same maimer. The respective power distribution manifold 112 is connected through the respective manifold module to the circuit board 60 for each of the respective spray valves 50.

As indicated above, each circuit board 60 provides an amplifier so that the signals provided from the power distribution manifold are amplified and then transmitted to the individual solenoids. As indicated above, separate signals are provided for each solenoid 65 so that each valve 50 may be controlled independently of the others.

Figure 7:
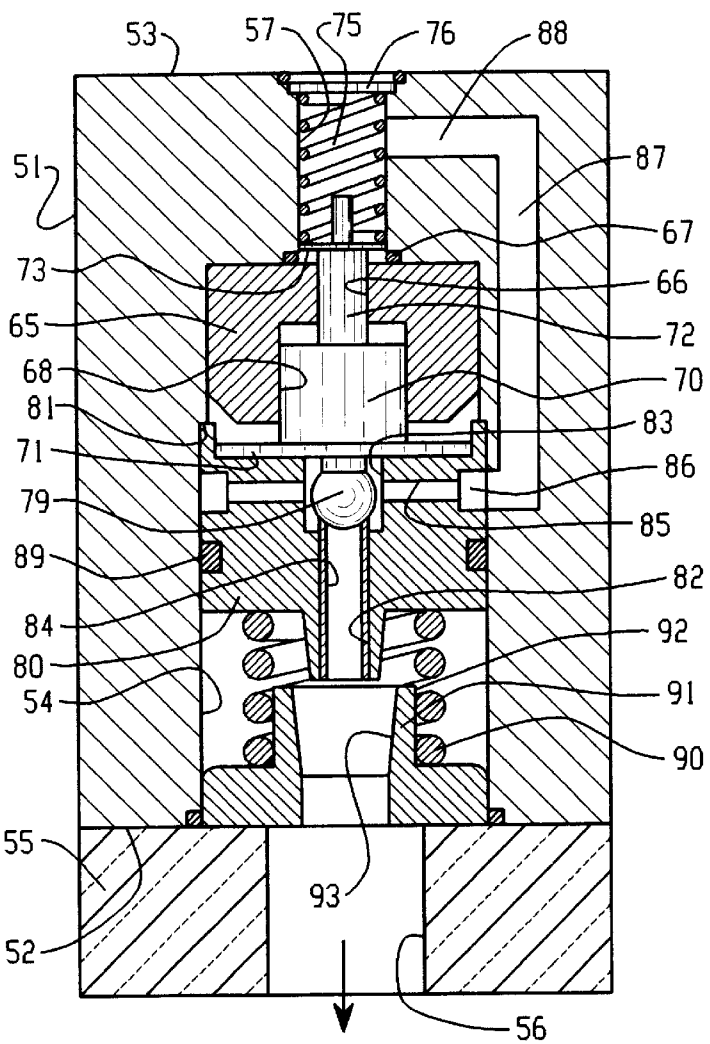
FIG. 7 is a sectional view on an enlarged scale taken on the line 7—7 of FIG. 5 and showing the valve in its closed position.

As indicated above, the spray control valves 50 are open (i.e. liquid lubricant is released to the air flow to be atomized and discharged in the form of a spray) when the respective solenoid 65 is energized as shown in FIG. 8 (i.e. by a control pulse). In between pulses, the spray head is closed by the armature spring 75 and the supply of liquid lubricant is cut off (FIG. 7). Thus the percentage of time that the solenoid is energized, determines the liquid lubricant flow rate. The greater the percentage of time the solenoid is energized, the greater the flow rate. The pulse rate used is preferably quite high (e.g. in the 80 Hz range).

The central control processor 102 utilizes a 100 increment time base for controlling the pulse generator 111. In other words, the time base is 100 milliseconds so that each increment is 1 millisecond. This assures extremely accurate flow control.

Since a solenoid operated valve requires a greater force to open the valve initially than to hold it open, the central control processor 102 provides an initially high-power state for rapid actuation followed by a reduced power level for the rest of the pulse. This reduces power consumption and minimizes heat buildup.

With the control system thus described, each spray control valve 50 may be programmed to provide a liquid lubricant spray at desired discrete time intervals during a reciprocating motion cycle of the spray head assembly 10. With each such interval, a separate and distinct liquid lubricant flow rate may be selected. This enables an optimum amount of lubricant to be sprayed on each portion of a mold in a die casting machine in between operating cycles.

One particular advantage of the system is that it avoids the need to adjust the pressure level of the liquid lubricant in order to change the flow rate.

While the invention has been shown and described with respect to a particular embodiment thereof this is for the purpose of illustration rather than limitation and variations and modifications of the specific device shown will be readily apparent to those skilled in the art all within the intended spirit and scope of the invention. Accordingly, the patent is not to be limited in scope and effect to the particular embodiment herein shown and described nor in any way that is inconsistent with the extent to which the progress in the art has been advanced by the invention.

We claim:

1. A spray device using a gas propellant for spraying a liquid and an integral valve for controlling the flow rate of the liquid to be sprayed, comprising:

a housing defining:

a gas flow passage for the propellant, a liquid flow passage for the liquid to be sprayed, and a valve seat defining a port communicating between said liquid flow passage and said gas flow passage, an armature assembly including a valve head movable between an extended position in sealing engagement with said valve seat and a retracted position permitting liquid to enter said gas flow passage from said liquid flow passage, a solenoid in said housing operatively associated with said armature assembly and adapted when energized to move said valve head to said retracted position, means urging said valve head to said extended position, a pulse generator for applying a controlled train of current pulses to said solenoid whereby said valve head is rapidly cycled between its open and closed positions when said pulse generator is activated; and control means for actuating said pulse generator for discrete time intervals, each interval comprising a modulated train of current pulses that are applied to said solenoid to initiate and control the flow of said liquid into said gas flow passage during said discrete time interval.

2. A spray device as defined in claim 1 wherein said armature assembly includes an armature plate formed of electromagnetic material located at the forward end of said solenoid and adapted to be urged toward said forward end of said solenoid when said solenoid is actuated.

3. A spray device as defined in claim 2 wherein said valve head comprises a carbide ball fused to a central portion of said armature plate.

4. A spray device as defined in claim 1 wherein said means urging said valve head to said retracted position comprises a helical spring.

5. A spray device as defined in claim 4 wherein said housing defines a central axis and wherein said solenoid has an axis that is coexistent with said central axis of said housing.

6. A spray device as defined in claim 5 wherein said armature assembly further includes a rearward extension with a portion thereof located within and extending axially through and beyond said solenoid, and wherein said rearward extension is engaged by and biased in a forward axial direction by said helical spring to urge said valve head into sealing engagement with said valve seat.

7. A spray device as defined in claim 1 wherein said pulse generator is controlled by a central control processor adapted to generate an actuating signal to said solenoid, comprising a series of pulses over a discrete time interval.

8. A spray device as defined in claim 7 wherein said central control processor uses a 100 increment time base for controlling said pulse generator whereby the time increment for said pulses is 1 millisecond.

9. A spray device as defined in claim 7 wherein said actuating signal generated by said central control processor has an initially relatively high power state for rapid actuation of said solenoid followed by a reduced power level for the remaining portion of the signal.

* * * * *

UNITED STATES PATENT AND TRADEMARK OFFICE

CERTIFICATE OF CORRECTION

PATENT NO : 5,878,960

DATED : March 9, 1999

INVENTOR(S) : McInerney, II et al.

It is certified that error appears in the above-identified patent and that said Letters Patent is hereby corrected as shown below:

Column 5, line 54, delete "wh" and insert --Hz--.

Column 7, line 9, insert --,-- after "thereof".

Signed and Sealed this

Twenty-ninth Day of June, 1999

*Attest:*

Q. TODD DICKINSON

*Attesting Officer*

*Acting Commissioner of Patents and Trademarks*